US010612793B1

(12) United States Patent
Kuster et al.

(10) Patent No.: US 10,612,793 B1
(45) Date of Patent: Apr. 7, 2020

(54) WATER DELIVERY SYSTEM

(71) Applicants: Hans L. Kuster, Barrington, RI (US); Michael McNamara, Coventry, RI (US); Michael Ferruccio, Warwick, RI (US); John Papa, Warwick, RI (US)

(72) Inventors: Hans L. Kuster, Barrington, RI (US); Michael McNamara, Coventry, RI (US); Michael Ferruccio, Warwick, RI (US); John Papa, Warwick, RI (US)

(73) Assignee: AquaMotion, Inc., Barrington, RI (US)

( * ) Notice: Subject to any disclaimer, the term of this patent is extended or adjusted under 35 U.S.C. 154(b) by 0 days.

(21) Appl. No.: 15/979,743

(22) Filed: May 15, 2018

(51) Int. Cl.
*F24D 17/00* (2006.01)
*F24H 1/12* (2006.01)

(52) U.S. Cl.
CPC ..... *F24D 17/0078* (2013.01); *F24H 1/122* (2013.01); *Y10T 137/6497* (2015.04)

(58) Field of Classification Search
CPC ..... F24D 17/0078; F24D 19/1051; Y10T 137/6497
See application file for complete search history.

(56) References Cited

U.S. PATENT DOCUMENTS 5,205,318 A * 4/1993 Massaro ..... F24D 17/0078 122/13.3
6,647,932 B1 * 11/2003 Cui ..... F24H 1/52 122/33
6,929,187 B2 * 8/2005 Kempf ..... E03B 7/045 236/12.11
8,083,500 B1 12/2011 Lebkuchner et al.
8,303,184 B1 11/2012 Lebkuchner et al.
9,328,736 B2 5/2016 Lebkuchner et al.
9,863,647 B1 1/2018 McNamara et al.
2009/0145490 A1 * 6/2009 Kershisnik ..... E03B 7/04 137/334
2010/0096018 A1 * 4/2010 Wylie ..... F24D 17/0078 137/2
2016/0186415 A1 * 6/2016 Yuge ..... F24D 17/0078 137/340

* cited by examiner

*Primary Examiner* — Kevin F Murphy
(74) *Attorney, Agent, or Firm* — Salter & Michaelson

(57) ABSTRACT

There is provided a water delivery system that includes, hot and cold water lines that are for feeding hot and cold water to respective hot and cold water fixtures, a water heater having a cold water input and a hot water output, a water circulator for pumping water from the hot water outlet to the hot water fixture, a bypass line that couples between the water circulator and the cold water input and at least a first check valve constructed and arranged in the bypass line for selectively directing hot pumped water via the water circulator to the cold water input to the water heater while preventing flow in an opposite direction toward the water circulator. A second check valve is disposed in the cold water line for selectively directing cold water from the cold water line to the cold water input to the water heater while preventing flow in an opposite direction toward the cold water line.

25 Claims, 3 Drawing Sheets

WATER DELIVERY SYSTEM

FIELD OF THE INVENTION

The present invention relates in general to a novel water delivery system. The present invention also relates to a hot water recirculation system that can be installed on tank-less water heaters or other water heaters such as installed on wall hung "combi" boilers. More particularly, the present invention relates to a bypass circulation loop through the heater driven by a circulating pump with flow control to manage the flow rate through the water heater, along with a novel combination of check valves to control the direction of flow to and from the bypass. The present invention may be used with hot water recirculation valves that are mounted at or near the hot water fixtures and which use the cold water supply line as a return for the circulating hot water.

BACKGROUND OF INVENTION

There are primarily two types of hot water heaters used in homes and light commercial applications. The most established is hot water heaters that employ a tank to store heated water. There are several methods for adapting hot water recirculation to these tank applications. These include systems with dedicated return lines and under sink circulators or valves that use the cold supply line to the fixture to return the cooled hot water to the hot water tank. The other common type of hot water heater is the tank-less water heater which may only be a water heater or it may incorporate a boiler with a space heating element. If the unit does both water heating and space heating it is referred to as a "combi" boiler. These tank-less heaters operate based on a demand for hot water so they only activate when a hot fixture is opened and a minimum flow is established. The requirement of tank-less units limits the methods available for the incorporation of hot water recirculation. The methods available are dedicated return lines, under sink circulators, or a buffer heating tank which maintains hot water when there is no hot water demand at the fixtures. Currently available under sink valves do not allow sufficient water flow through a tank-less heater to activate the heater.

Accordingly, it is the object of this invention to provide a bypass system that can be used with either a tank-less water heater or a tank-less "combi" boiler which will maintain hot water at the fixture when applied with an under-sink bypass valve.

SUMMARY OF THE INVENTION

The present invention replaces the need for a minimum flow rate at the fixtures to activate the tank-less heater by establishing a sufficient continuous flow through the tank-less heater to meet the minimum flow demand needed to activate the heater. A flow control valve can be used to maintain only the flow needed to activate the heater. By not exceeding the flow needed the cycling of the heater is reduced. Insulation of the bypass further reduces the cycling of the heater. Reducing the cycling of the heater increases the life of the heater. In accordance with the present invention check valves are used to keep cold water from entering the hot water output line of the heater through the bypass line and to keep hot water from entering the cold input line to the heater through the bypass. Installation of the bypass can be made directly to the hot and cold input and output of the tank-less heater. A timer can be used to turn on and turn off the circulator (pump) in the bypass so that hot water is available at the fixture only when it is desired. The timer feature is used to save energy during periods when hot water is not needed at the sink and to reduce cycling of the heater. In addition to the flow through the bypass a flow is established to an under-sink valve at the hot water fixture which in turn maintains hot water at the fixture when the bypass is active by returning this flow through the cold water supply line to the fixture.

In accordance with other embodiments of the present invention there is provided a water delivery system that is comprised of: hot and cold water lines that are for feeding hot and cold water to respective hot and cold water fixtures; said hot water line including a hot water outlet pipe for receiving hot water from a hot water source and a hot water exit pipe that couples to the hot water fixture, said cold water line including a cold water supply pipe for receiving cold water from a cold water source and a cold water exit pipe that couples to the cold water fixture; a water circulator for pumping water from the hot water outlet pipe to the hot water fixture; a bypass line that couples between the water circulator and the cold water supply pipe; and a check valve constructed and arranged in the bypass line.

In accordance with other aspects of the present invention the check valve is for selectively directing hot pumped water to a cold water input to the hot water source while preventing flow in an opposite direction toward the water circulator; the water source is a tank-less water heater; wherein there is also included a second check valve that is disposed in the cold water supply pipe; and wherein the second check valve is for selectively directing cold water from the cold water supply pipe to the cold water input to the hot water source while preventing flow in an opposite direction toward the cold water supply pipe.

In accordance with still other embodiments of the present invention there is provided a water delivery system that is comprised of: hot and cold water lines that are for feeding hot and cold water to respective hot and cold water fixtures; said hot water line including a hot water outlet pipe for receiving hot water from a hot water source and a hot water exit pipe that couples to the hot water fixture, said cold water line including a cold water supply pipe for receiving cold water from a cold water source and a cold water exit pipe that couples to the cold water fixture; a water circulator for pumping water from the hot water outlet pipe to the hot water fixture; a bypass line that couples between the water circulator and the cold water supply pipe; and a check valve that is disposed in the cold water supply pipe.

In accordance with still other aspects of the present invention the check valve is for selectively directing cold water from the cold water supply pipe to the cold water input to the hot water source while preventing flow in an opposite direction toward the cold water supply pipe; the water source is a tank-less water heater; wherein there is also provided a second check valve that is constructed and arranged in the bypass line; wherein the second check valve is for selectively directing hot pumped water to a cold water input to the hot water source while preventing flow in an opposite direction toward the water circulator; wherein the check valve is part of a T-shaped junction structure having a main coupling line that contains the check valve and a side disposed line that couples to the second check valve.

In accordance with still further embodiments of the present invention there is provided a water delivery system that is comprised of: hot and cold water lines that are for feeding hot and cold water to respective hot and cold water fixtures; a water heater having a cold water input and a hot water output; a water circulator for pumping water from the hot water outlet to the hot water fixture; a bypass line that couples between the water circulator and the cold water input; and at least a first check valve constructed and arranged in the bypass line for selectively directing hot pumped water via the water circulator to the cold water input to the water heater while preventing flow in an opposite direction toward the water circulator.

In accordance with still further aspects of the present invention the water heater is a tank-less water heater or a combi heater; further including a second check valve that is disposed in the cold water line; the second check valve is for selectively directing cold water from the cold water line to the cold water input to the water heater while preventing flow in an opposite direction toward the cold water line; further including a T-shaped structure having multiple ports and intercoupling the cold water line and the cold water input to the water heater; and the T-shaped structure includes a main coupling line that contains the second check valve and a side disposed line that couples to the first check valve.

BRIEF DESCRIPTION OF THE DRAWINGS

It should be understood that the drawings are provided for the purpose of illustration only and are not intended to define the limits of the disclosure. In the drawings depicting the present invention, all dimensions are to scale. The foregoing and other objects and advantages of the embodiments described herein will become apparent with reference to the following detailed description when taken in conjunction with the accompanying drawings in which.

DETAILED DESCRIPTION

Figure 1:
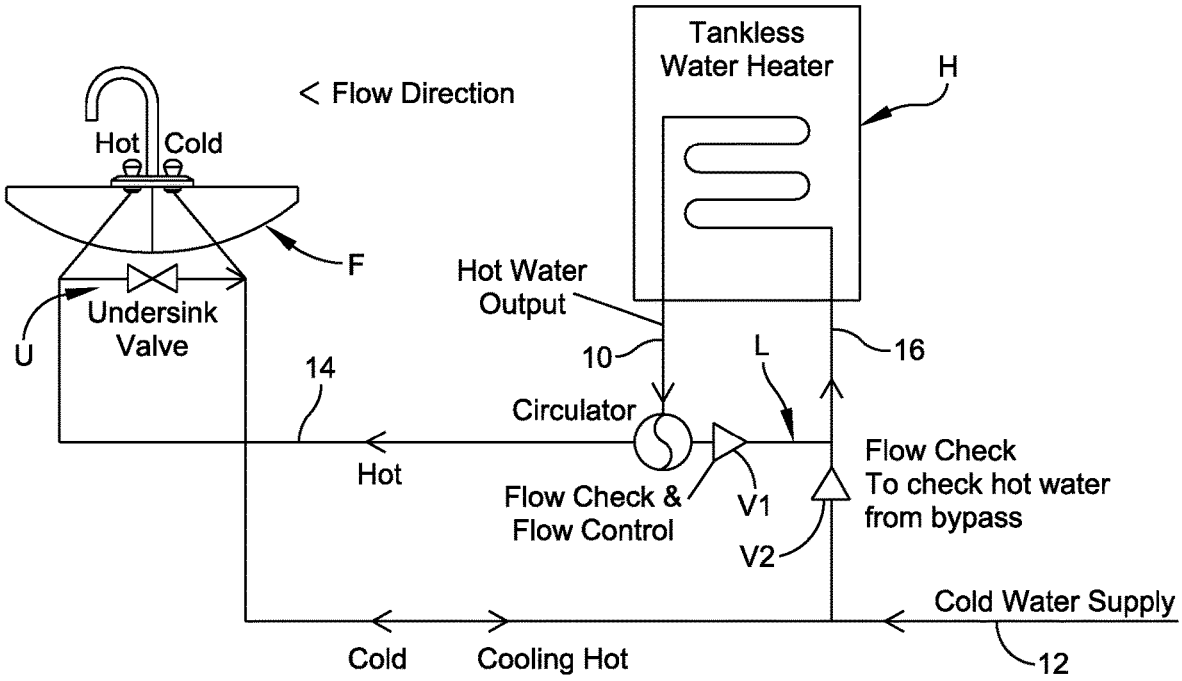
FIG. 1 is a schematic block diagram of a water delivery system as in accordance with the present invention.

To accomplish the foregoing and other objects, features and advantages of the present invention there is disclosed herein, in FIG. 1 a preferred version of one system as used with a tank-less water heater. Although the preferred system of the present invention is described in connection with a tank-less water heater, it is understood that the principles described herein may also apply to standard water heaters that usually incorporate one or more relatively large water storage containers. FIG. 1 is a schematic block diagram of a water delivery system as in accordance with the present invention and showing one typical fixture of which there are usually several in any one water delivery system.

A method and system of the present invention mounts external to water heater to allow, in particular, tank-less hot water heaters and wall hung "combi" boilers to accommodate hot water recirculation valves that use the cold water supply lines to fixtures as the return line to the water heater. This method and system of the present invention uses a circulation pump with a built-in or externally mounted bypass connection with a flow control, check valve and/or a combination of flow control and check valve arranged to circulate hot water to the homes plumbing fixtures and back through the bypass to the cold water supply of the tank-less water heater. This flow simulates a hot water demand on the tank-less heater. The bypass flow is controlled to supply a sufficient flow to trigger the tank-less heater to begin heating. When the temperature in the bypass flow reaches the maximum temperature at which the tank-less water heater stops heating, the water heater shuts off. After the water heater shuts off the temperature in the bypass loop "L" begins to cool. When the bypass flow cools to the minimum allowed by the water heater the water heater is triggered to restart. A timing circuit can be incorporated with the circulator to save energy and reduce the cycling of the tank-less heater.

Figure 2A:
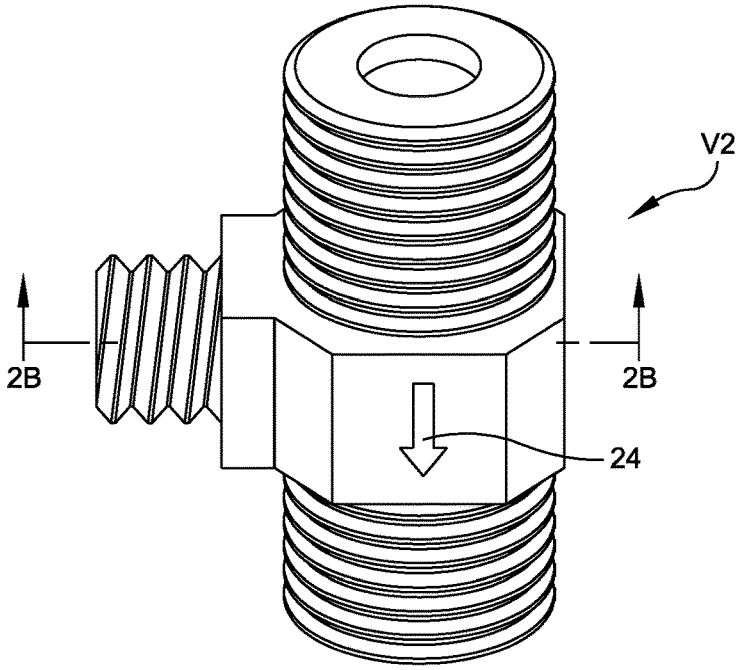
FIGS. 2A and 2B are respective perspective and cross-sectional views of the T-shaped member incorporating a check valve associated with the cold water side.
Figure 2B:
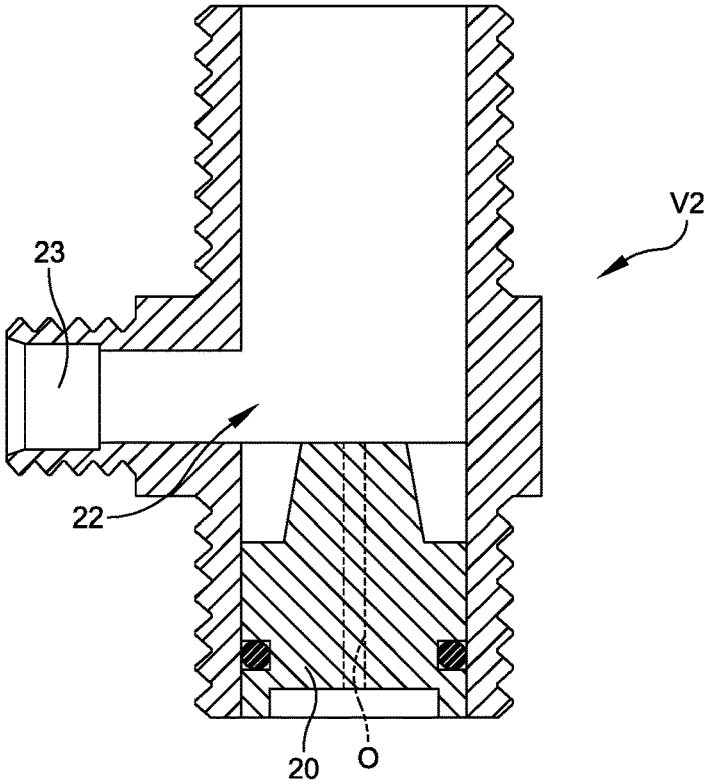

For an embodiment of the present invention refer to the schematic block diagram of FIG. 1. Refer also to FIGS. 2A and 2B that are respective perspective and cross-sectional views of the T-shaped member incorporating a check valve associated with the cold water side and FIGS. 3A and 3B that are respective perspective and cross-sectional views of the member that contains the check valve associated with the bypass line. In FIG. 1 there is described a hot water bypass system that is intended for use with and external to a tank-less water heater H and/or a tank-less "combi" boiler. The system includes a hot water output at line 10 from the water heater H, a cold water supply line 12 that couples to the bypass system or loop L and a hot water supply line 14 to a fixture F. The hot water line 10 from the water heater H connects directly or indirectly to a circulating pump or circulator P that discharges a portion of the hot water being circulated from the output of the heater through a bypass water line (loop L) to the cold water supply to the water H heater as indicated at 16 in FIG. 1. The system depicted in FIG. 1 shows a bypass loop L that is used with either a tank-less water heater or a tank-less "combi" boiler and which maintains hot water at the fixture F when applied with an under-sink bypass valve U.

In the system of FIG. 1, the bypass flow is of a magnitude sufficient to activate the water heater H while the remaining hot water is circulated from the output of the heater to a valve or valves at a hot water fixture or fixtures to maintain hot water at each and all of the fixture F. Within the bypass line or loop L there is disposed a first check valve V1 that inhibits the flow of cold water from the cold water supply line 16 to the bypass from entering the hot water output line 10/14 from the heater and a second check valve V2 that inhibits the flow of hot water from the bypass loop L from entering the cold water supply line 12.

The first check valve V1 is for selectively directing hot pumped water to the cold water input to the water heater H while preventing flow in an opposite direction toward the water circulator or pump P (from the hot side to the cold side). The second check valve V2 is disposed in the cold water supply pipe 12. The second check valve V2 is for selectively directing cold water from the cold water supply pipe 12 to the cold water input to the water heater H while preventing flow in an opposite direction toward the cold water supply pipe 12. In accordance with the present invention the connections to the bypass elements (loop L) are compatible with various piping types such as, Pex, Uponor Pex, Propress, copper sweat, pipe threads. Various components shown in FIG. 1 may be arranged in a combined manner. For example, the discharge connection to the bypass loop of the circulator may be incorporated into the circulator. The check valve V1 may be incorporated into the circulator. The aforementioned timer may also be incorporated into the circulator.

Reference is now also made to FIGS. 2A and 2B which are respective perspective and cross-sectional views of the Tshaped valve member V2. As illustrated in particular in FIG. 2B, the cross-sectional view illustrates the open port arrangement with a T connection at 22. The lateral port at 23 connects to the bypass loop L. In FIG. 2A the arrow at 24 indicates the direction of flow. In FIG. 2B at 20 there is a schematic illustration of the check valve that allows the flow only in the direction of arrow 24. In FIG. 2B the check valve 20 is illustrated in a very schematic manner. Various types of one-way check valves are known in the art and may be employed.

Figure 3A:
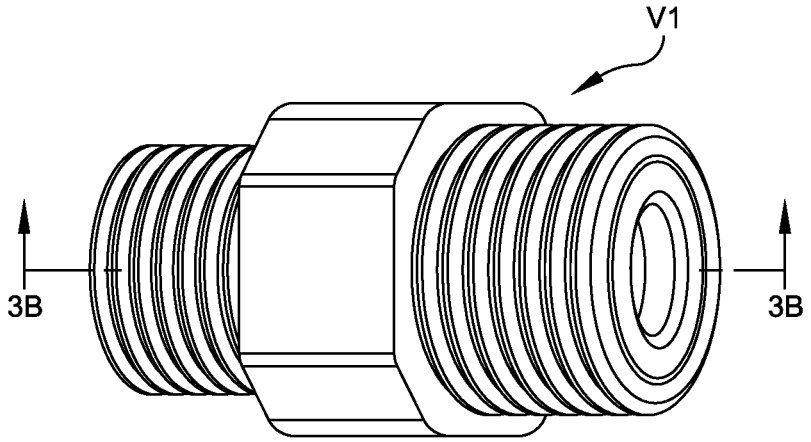
FIGS. 3A and 3B are respective perspective and cross-sectional views of the member that contains the check valve associated with the bypass line.
Figure 3B:
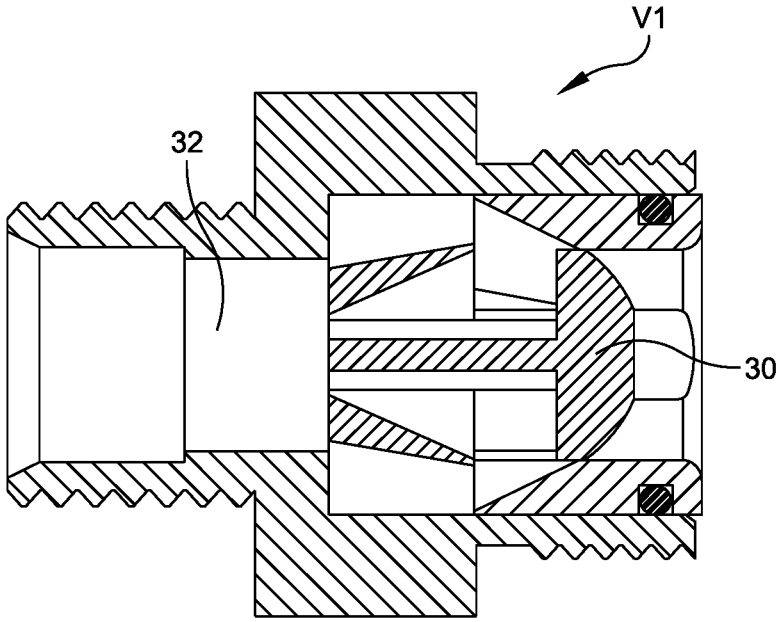

FIGS. 3A and 3B are respective perspective and cross-sectional views of the valve member V1 that contains a check valve associated with the bypass loop L. Thus, in the cross-sectional view of FIG. 3B there is shown the open port arrangement at 32 with the check valve 30 shown in position. The check valve 30 allows flow in the direction from left to right in FIG. 3B and inhibits flow in the opposite direction.

Each of the check valves illustrated in FIGS. 2A, 2B and 3A, 3B may also incorporate some type of a flow restriction. This may be accomplished by narrowing the orifice O that extends through the member or through the check valve itself. Particularly with respect to valve V1, it is desired that the flow through the check valve be somewhat restricted so that a sufficient flow from the tankless water heater is coupled by way of the circulator P to the hot water line 14 that couples to one or more fixtures F. A similar restriction of an orifice O may also be associated with the valve member V2 so as to control the flow from the cold water supply line 12 to the cold water input to the water heater H and the bypass loop L. As far as the valve mechanism V1 is concerned, it has been found that there is a critical range of flow through the check valve 30. As indicated previously, this flow is controlled by a substantial restriction in the orifice O. In the cross-sectional view of FIG. 3B this could be by the use of a restrictive orifice O at the port area 32. Also, the restriction may occur by the proper selection of the check valve 30 in FIG. 3B. The critical range of flow has been found to be in a range of 0.4 to 1.5 gallons per minute. Check valves having those characteristics are available. The criticality of this check valve 30 comes about because one wants to make sure that a proper flow of hot water is coupled to the fixtures while at the same time providing a sufficient flow through the check valve 30 to excite the tankless water heater H. By experimentation, this flow has been found to be in a preferred range of 0.4 to 1.5 gallons per minute. One particular valve that was selected had a flow of 1.05 gallons per minute. As indicated previously, various forms of check valves may be employed with the check valves illustrated in FIGS. 2B and 3B being in more of a schematic form.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A water delivery system that is comprised of:

hot and cold water lines that are for feeding hot and cold water to respective hot and cold water fixtures;

said hot water line including a hot water outlet pipe for receiving hot water from a hot water source and a hot water exit pipe that couples to the hot water fixture, said cold water line including a cold water supply pipe for receiving cold water from a cold water source and a cold water exit pipe that couples to the cold water fixture;

a water circulator for pumping water from the hot water outlet pipe to the hot water fixture;

the cold water supply pipe feeding a junction, wherein a first cold water exit pipe extends between the junction and the cold water fixture, and a second cold water exit pipe extends between the junction and the water heater;

a bypass line that extends between the water circulator and the second cold water exit pipe;

and a check valve constructed and arranged in the bypass line, the check valve positioned so as to selectively direct the hot water from the water circulator to the second cold water exit pipe while preventing flow in an opposite direction toward the water circulator;

and wherein the water source is a tank-less water heater.

2. The water delivery system of claim 1 wherein the cheek valve is for selectively directing hot pumped water froth the water circulator to a cold water input to the hot water source while preventing flow in an opposite direction toward the water circulator, said check valve additionally providing a flow control restriction therethrough by means of a restrictive orifice.

3. The water delivery system of claim 2 wherein the check valve provides a flow control rate that is in a range of 0.4 to 1.5 gallons per minute.

4. The water delivery system of claim 1 including a second check valve that is disposed in the second cold water exit pipe.

5. The water delivery system of claim 4 wherein the second check valve is for selectively directing cold water from the second cold water exit pipe to a cold water input to the hot water source while preventing flow from the bypass line in an opposite direction toward the junction.

6. The water delivery system of claim 1 wherein the check valve provides a flow control rate that is in a range of 0.4 to 1.5 gallons per minute.

7. The water delivery system of claim 1, wherein the water circulator comprises:

an inlet for receiving the hot water from the hot water source;

a first outlet for selectively pumping the hot water to the hot water fixture; and a second outlet for discharging a portion of the hot water through the bypass line via the check valve.

8. The water delivery system of claim 1, wherein the water circulator comprises:

an inlet for receiving the hot water from the hot water source;

a first outlet for selectively pumping the hot water to the hot water fixture; and a second outlet for connecting to the check valve in the bypass line so as to selectively direct the hot water to the second cold water exit pipe while preventing flow in an opposite direction toward the water circulator.

9. A water delivery system that is comprised of:

hot and cold water lines that are for feeding hot and cold water to respective hot and cold water fixtures;

said hot water line including a hot water outlet pipe for receiving hot water from a hot water source and a hot water exit pipe that couples to the hot water fixture, said cold water line including a cold water supply pipe for receiving cold water from a cold water source and a cold water exit pipe that couples to the cold water fixture:

a water circulator for pumping water from the hot water outlet pipe to the hot water fixture;

the cold water supply pipe feeding a junction, wherein a first cold water exit pipe extends between the junction and the cold water fixture, and a second cold water exit pipe extends between the junction and the water heater;

a bypass line that extends between the water circulator and the second cold water exit pipe;

and a check valve that is disposed in the bypass line, the check valve configured to selectively direct the hot water to the second cold water exit pipe while preventing flow in an opposite direction toward the water circulator;

and wherein the water source is a tank-less water heater and the check valve includes a restrictive through orifice.

10. The water delivery system of claim 9 wherein the check valve is for selectively directing hot water from the water circulator to a cold water input to the hot water source while preventing flow in an opposite direction toward the water circulator.

11. The water delivery system of claim 10 wherein the check valve has a restrictive through orifice for flow control in a range of 0.4 to 1.5 gallons per minute.

12. The water delivery system of claim 9 including a second check valve that is constructed and arranged in the second cold water exit pipe.

13. The water delivery system of claim 12 wherein the second check valve is for selectively directing cold pumped water to a cold water input to the tank-less water heater while preventing flow in an opposite direction toward the cold water supply pipe.

14. The water delivery system of claim 13 wherein the check valve is part of a T-shaped junction structure having a main coupling line that contains the check valve and a side disposed line that couples to the second check valve.

15. The water delivery system of claim 9 wherein the check valve has a restrictive through orifice for flow control in a range of 0.4 to 1.5 gallons per minute.

16. A water delivery system that is comprised of:

hot and cold water lines that are for feeding hot and cold water to respective hot and cold water fixtures;

a water heater having a cold water input and a hot water output;

a water circulator for pumping water from the hot water outlet to the hot water fixture;

the cold water line feeding a junction, wherein a first cold water line extends between the junction and the cold water fixture; and a second cold water line extends between the junction and the water heater;

a bypass line that extends between the water circulator and the second cold water line;

and at least a first check valve constructed and arranged in the bypass line for selectively directing hot pumped water from the water circulator to the second cold water line to the water heater while preventing flow in an opposite direction toward the water circulator;

and wherein the water heater is a tank-less water heater.

17. The water delivery system of claim 16 wherein the tank-less water heater is comprised of a combination boiler that provides both water heating and space heating.

18. The water delivery system of claim 16 including a second check valve that is disposed in the second cold water line.

19. The water delivery system of claim 18 wherein the second check valve is for selectively directing cold water from the cold water line to the cold water input to the water heater while preventing low in an opposite direction toward the cold water line.

20. The water delivery system of claim 18 including a T-shaped structure having multiple ports and intercoupling the cold water line and the cold water input to the water heater, and an under-sink bypass valve disposed between the cold and hot water fixtures.

21. The water delivery system of claim 20 wherein the T-shaped structure includes a main coupling line that contains the second check valve and a side disposed line that couples to the first check valve.

22. The water delivery system of claim 16 wherein the check valve includes a restrictive through orifice for flow control in a range of 0.4 to 1.5 gallons per minute.

23. A water delivery system that is comprised of:

hot and cold water lines that are for feeding hot and cold water to respective hot and cold water fixtures;

said hot water line including a hot water outlet pipe for receiving hot water from a hot water source and a hot water exit pipe that couples to the hot water fixture, said cold water line including a cold water supply pipe for receiving cold water from a cold water source and a cold water exit pipe that couples to the cold water fixture and that is comprised of a first cold water exit pipe and a second cold water exit pipe;

a water circulator for pumping water from the hot water outlet pipe to the hot water fixture;

the cold water supply pipe feeding a junction, wherein the first cold water exit pipe extends between the junction and the cold water fixture, and the second cold water exit pipe extends between the junction and the water heater;

a bypass line that extends between the water circulator and the second cold water exit pipe;

and a check valve constructed and arranged in the bypass line, the check valve positioned so as to selectively direct the hot water from the water circulator to the second cold water exit pipe while preventing flow in an opposite direction toward the water circulator.

24. The water delivery system of claim 23 including a second check valve that is disposed in the second cold water exit pipe.

25. The water delivery system of claim 24 wherein the second check valve is for selectively directing cold water from the second cold water exit pipe to a cold water input to the hot water source while preventing flow from the bypass line in an opposite direction toward the junction.

* * * * *